United States Patent [19]

Wong et al.

[11] Patent Number: 4,802,675

[45] Date of Patent: Feb. 7, 1989

[54] TOY GUN

[76] Inventors: David L. W. Wong, 1040 West 55 Avenue, Vancouver, British Columbia, Canada, V6P 1R1; Paul C. P. Leung, 3590 Osler Street, Vancouver, British Columbia, Canada, V6H 2W6; Friederich H. Spissinger, 3343 West Broadway, Vancouver, British Columbia, Canada, V6R 2B1

[21] Appl. No.: 911,148

[22] Filed: Sep. 24, 1986

[30] Foreign Application Priority Data

Jan. 20, 1986 [GB] United Kingdom ..... 8601299

[51] Int. Cl.[4] ..... A63H 33/26

[52] U.S. Cl. ..... 273/310; 273/311; 362/277; 446/473

[58] Field of Search ..... 273/310, 311, 312; 362/187, 277, 293; 446/473

[56] References Cited

U.S. PATENT DOCUMENTS

| | | | |
|---|---|---|---|
| 2,414,338 | 1/1947 | Simmon | 362/293 |
| 2,727,136 | 12/1955 | Vought | 273/310 |
| 2,879,379 | 3/1959 | Lyons | 362/321 |
| 3,130,317 | 4/1964 | Connelly et al. | 273/310 |
| 3,179,791 | 4/1965 | Mole | 362/293 |
| 3,633,285 | 1/1972 | Sensney | 273/310 |
| 3,918,714 | 11/1975 | Ceccaroni | 273/310 |
| 4,365,439 | 12/1982 | Litynski | 273/310 |

*Primary Examiner*—Leo P. Picard

*Attorney, Agent, or Firm*—Fetherstonhaugh & Co.

[57] ABSTRACT

A game comprising a toy gun and an electronic target which registers hits produced by the gun. The gun comprises an electronic flash tube connected to a circuit to produce a high voltage unidirectional supply from a low voltage supply. When the gun trigger is depressed, the flash tube is fired and the resulting light is concentrated to produce a relatively narrow beam of light. As well, an audio signal is produced for each press of the trigger. If the beam of light impinges on the electronic target, an audio-visual signal results to indicate a hit.

28 Claims, 3 Drawing Sheets

TOY GUN

FIELD OF THE INVENTION

This invention relates to toy guns, and particularly, but not exclusively, to the combination of a toy gun and a target which registers, electronically, notional "hits" thereon, without the need to fire solid, fluid or other projectiles having mass.

DESCRIPTION OF THE PRIOR ART

Many toy gun designs incorporate some type of audio and visual indication of the firing of the gun, and some also fire projectiles. The user satisfaction level from all of these designs cannot be maintained for long periods of time, except for the very young. The guns have associated problems, such as poor accuracy and consistency, very loud noises (e.g. from cap guns), short operating distances, and danger from projectiles. In the past few years, paint pellet guns have been successfully applied to survival and combat games. Infrared devices have been used with tremendous success. People of various age groups like to participate, but these guns are not suitable for mass consumer distribution, due to the danger and mess of the paint pellets and the danger, cost, and weight of the infrared gun.

SUMMARY OF THE INVENTION

It is an object of the present invention to provide an improved toy gun.

According to one aspect of the invention, there is provided a game comprising a toy gun, including an electronic flash tube; means to provide a relatively low-voltage direct current supply; means to produce from the low-voltage supply a relatively high-voltage undirectional supply; means coupled to the high-voltage supply to fire the flash tube in response to pressure on a triger of the gun; and means to concentrate the resultant flash of light from the flash tube into a relatively narrow beam for projection at a target.

According to another aspect of the invention there is provided a game comprising a toy gun including an electronic flash tube; means to provide a relatively low-voltage direct current supply; means to produce from the low-voltage supply a relatively high-voltage unidirectional supply; means coupled to the high-voltage supply to fire the flash tube in response to pressure on a trigger of the gun; and means to concentrate the resultant flash of light from the flash tube into a relatively narrow beam for projection at a target; in combination with an electronic target including means responsive to impinging of the beam of light thereon to provide an output signal indicating that the gun has been accurately aimed thereat.

DRAWINGS

An embodiment of the invention will now be described, by way of example, with reference to the accompanying drawings, in which.

DESCRIPTION OF THE PREFERRED EMBODIMENTS

Figure 1:
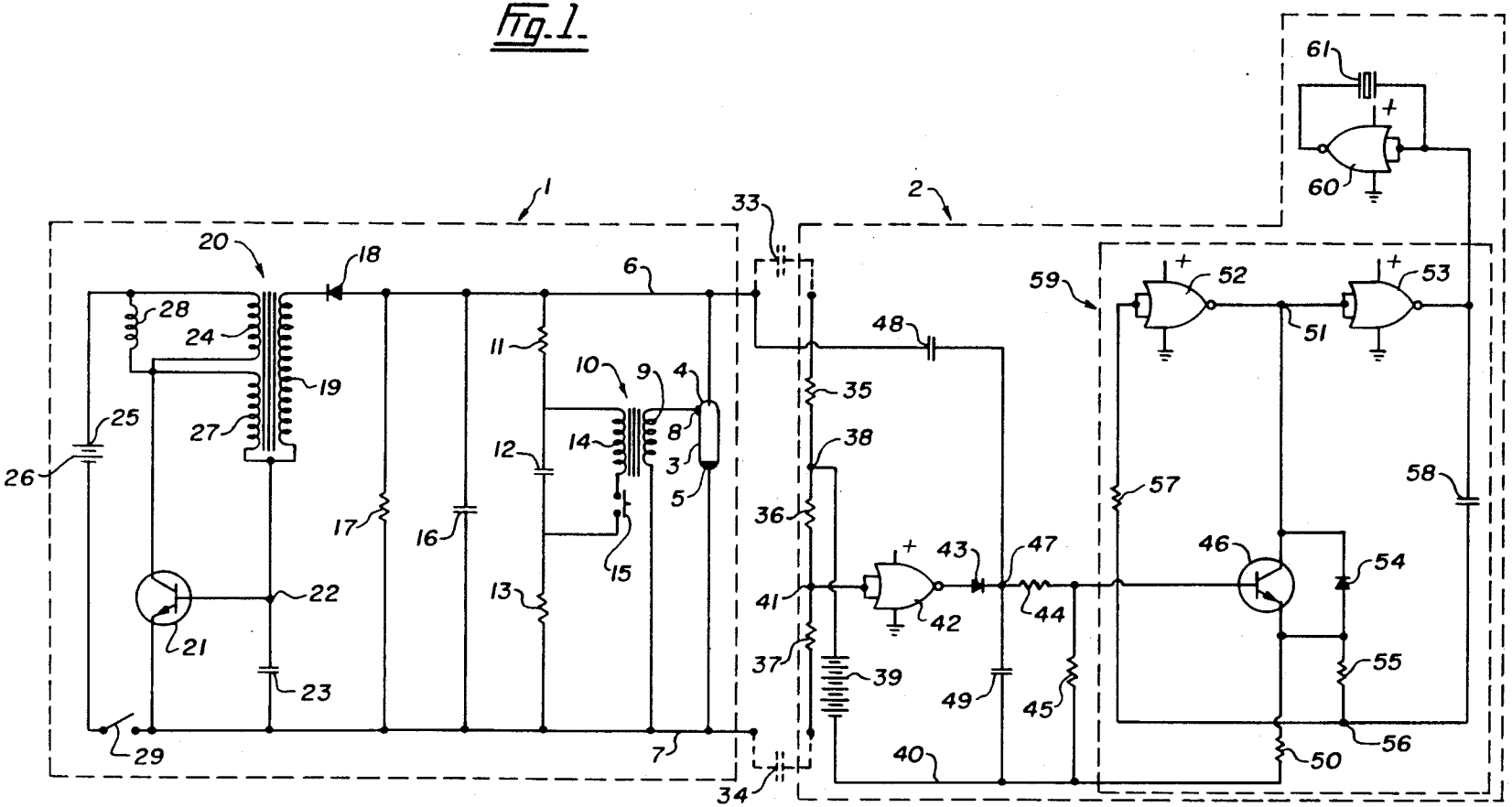
FIG. 1 is a circuit diagram of an emitter circuit forming part of a toy gun according to the invention.

Referring to FIG. 1 of the drawings, a toy gun (not shown) has incorporated therein a light emitter and sound effects circuit comprising an electronic flash module 1 and a sound effects module 2. The electronic flash module includes a flash tube 3 having electrodes 4 and 5 connected to lines 6 and 7, respectively. The trigger electrode 8 of the flash tube is connected to a secondary winding 9 of a triggering transformer 10. A series circuit comprising a resistor 11, a capacitor 12 and a resistor 13 is connected between the lines 6 and 7, and the primary winding 14 of the transformer 10, in series with a push-button switch 15, is connected across the capacitor 12. The switch 15 forms, or is mechanically coupled to, the trigger of the gun. A large capacitor 16 and a high-value resistor 17 are connected in parallel between the lines 6 and 7. The line 6 is connected to the anode of a diode 18, the cathode of which is connected to one end of the secondary winding 19 of an inverter transformer 20. The base of a transistor 21 is connected to a junction 22 between the other end of the winding 19 and one terminal of a capacitor 23. The emitter of the transistor and the other terminal of the capacitor 23 are connected to the line 7. The collector of the transistor is connected to one end of a primary winding section 24 of the transformer 20, the other end of which is connected to the positive terminal 25 of a battery 26. The battery may comprise a number of nickel-cadmium cells. A further primary winding section 27 of the transformer 20 is connected at one end to the junction 22 and at the other end to the terminal 25 via a resistor 28. The negative terminal of the battery 26 is connected via a switch 29 to the line 7.

To initiate operation of the flash module, the switch 29 is closed, thereby connecting the battery 26 to the primary winding sections 24 and 27. The capacitor 23 begins to charge via the resistor 28 and the winding section 27. When the voltage across the capacitor reaches a threshold level, the transistor 21 begins to conduct, allowing a current surge to pass through the winding section 24. This induces a current in the secondary winding 19. When the secondary winding current reaches saturation, the junction 22 has been pushed to a negative potential, which causes the transistor 21 to turn off. The capacitor 23 then discharges through the winding section 27 and the resistor 28. When the capacitor has discharged and has recharged to the threshold level, the transistor turns on again, and this cycle is repeated continuously.

The current in the secondary winding 19 charges the capacitor 16 via the diode 18, which prevents the capacitor from discharging through the winding 19 during the transistor off periods. The voltage across the capacitor (i.e. the voltage on the lines 6 and 7) reaches a value, say 300 volts, which is far in excess of the voltage of the battery 26. At the same time, the capacitor 12 is charged, via the resistors 11 and 13.

When the trigger of the gun is pressed, i.e. the switch 15 is closed, the capacitor 12 discharges through the winding 14, and a short pulse of approximately 4000 volts peak is generated across the secondary winding 9. This causes some ionisation of the gas in the tube 3. This provides a conductive path for the capacitor 16 to discharge through the tube, and a bright flash of light is thereby produced. The capacitors 16 and 12 then recharge, ready for the next pressing of the trigger.

When the switch 29 is opened at the end of play, the capacitors 16 and 12 discharge gradually through the high-value resistors 17, 11 and 13.

In another embodiment, trigger switch 15 could for example be electronically controlled by replacing the mechanical switch 15 by either a relay, SCR, transistor or other electronic switching means. This way, the firing rate can be varied continuously or in discrete steps as for the use of, say, a machine gun with different firing rates. A timer could also be provided in conjunction with the electronic trigger control so as to disable the triggering to allow the proper charging of the main capacitor 12 and/or to fix a maximum rate that a user can trigger the flash tube. The counter could be used to control the number of discharges for each pull of the trigger for example a three shot burst for each pull of the trigger. Also, a logic control cold also be used in conjunction with the electronic trigger. By using logic control, triggering would only be allowed when certain preset conditions are met. For example when a secret code word is entered to allow the emitter to be triggered thereby providing the possibility of individualizing the toy for each user.

By providing a capacitor bridge connected in parallel with electrodes 4 and 5 of flash tube 3, a user could vary the output power level by switching capacitors into and out of the circuit. The larger the capacitance the brighter the flash and the longer the duration of the flash. By having the flash pulse length variable, a number of code parameters can be created. For example the flash pulse output power level and length can be varied to create different types of emitters such as bow, gun, rifle, and rocket launchers. Also, different teams could be provided with different pulse lengths.

In another embodiment, an SCR connected in series with flash tube 3 and controlled by a timer can be used to provide a coded output by controlling the discharge duration of the flash tube. The maximum pulse without a flash can be controlled. The initiation of the flash could trigger a timer which will stop the discharge at the end of its timing cycle such that the maximum duration of the pulse is that of the timer. This would thereby provide a more reliable coding of the output flash.

Figure 2:
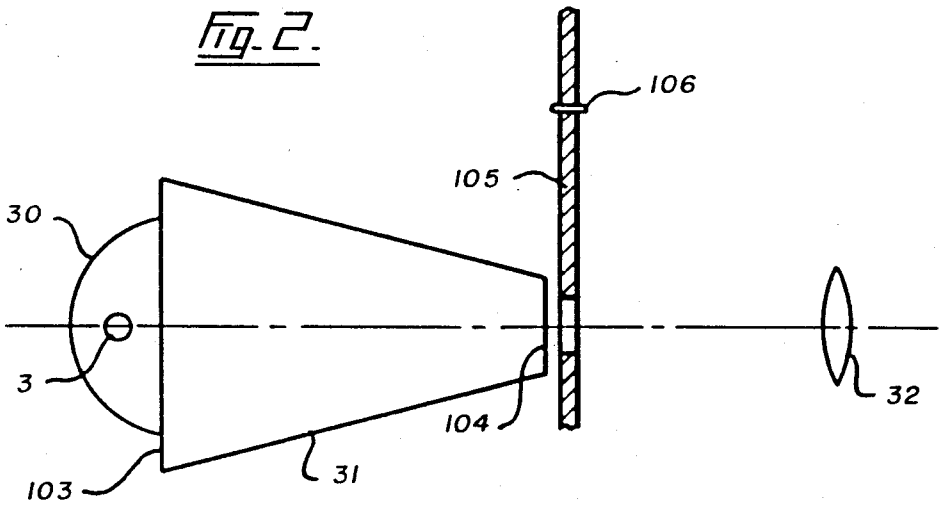
FIG. 2 is a shematic sectional view of an optics assembly forming part of the gun.

The flash of light is projected from the gun via an optics assembly, shown in FIG. 2, located in the body of the gun, in alignment with the gun barrel (not shown). The flash tube 3 is mounted at the focal point of a parabolic reflector 30, which projects the light into a concentrator 31 comprising a truncated cone. The light enters the large-diameter inlet end 103 of the concentrator and is concentrated towards the small-diameter outlet aperture end 104. A convex lens 32 is located in the barrel of the gun at a distance from the outlet aperture end 104 equal to the focal length of the lens. The small outlet aperture is required so that when the light beam is enlarged by the divergence of the lens, the light image at the target area will still be acceptably small. The concentrator may have a linear configuration as shown, or may be a hyperbolic cone or any other suitable shape which will concentrate the light towards a small outlet aperture. The effective shape and size of the outlet aperture may be made variable by locating a disc 105 adjacent the outlet aperture, the disc having apertures of various shapes and sizes therein which may be aligned at will, with the outlet aperture, by rotation of the disc about a central pivot 106, to provide a desired beam cross-section. Any or all of the apertures in the disc 105 may be provided with pieces of coloured light-filtering material to provide beams of desired colours. The outlet aperture 104 might, itself, be of a cross-section different from the circular section described above.

In yet another embodiment, the use of multiple lenses can help provide improved optical effects for the toy gun. For example, a collector lens such as lens 32 can be placed close to the reflector opening to concentrate the light down to a point thereby allowing more light to be used. Aperture plate 105 could then be placed close to the focal point of the collector lens thereby enhancing cross sectional shape of the beam. In an improved version of the toy gun, the optical system could be made adjustable such that the spread of the emerging beam can be controlled by the user. The advantage of this method over changing the size of the hole on aperture plate 105 is that the same amount of light can be used every time. Accordingly, when the divergence of the beam is made smaller the spot becomes brighter thereby achieving longer distances.

Referring again to FIG. 1, the sound effects module 2 is coupled to the lines 6 and 7 of the electronic flash module 1 by capacitors 33 and 34, which are preferably formed directly on the circuit board of modules 1 and 2, instead of being provided as discrete components. The capacitors 33 and 34 are connected to respective ends of a resistance chain comprising resistors 35, 36 and 37. A junction 38 between the resistors 35 and 36 is connected to the positive terminal of a battery 39, the negative terminal of which is connected to a line 40. A junction 41 between the resistors 36 and 37 is connected to parallelled inputs of a NOR-gate 42. The output of the gate 42 is coupled via a diode 43 and resistors 44 and 45 to the gate of a transistor 46, the diode 43 and the resistor 44 being inter-connected at a junction 47. A capacitor 48 is connected between the line 6 and the junction 47, and a capacitor 49 is connected between the junction 47 and the line 40. The emitter of the transistor 46 is connected via a resistor 50 to the line 40. The collector of the transistor is connected to a junction 51 between two NOR-gates 52 and 53, and is connected to the emitter via a diode 54. The emitter is also connected, via a resistor 55, to a junction 56 between a resistor 57 and a capacitor 58. The other end of the resistor 57 is connected to the parallelled inputs of the gate 52, and the other terminal of the capacitor 58 is connected to the output of the gate 53. The transistor 46, the resistors 50, 55 and 57, the capacitor 58, the NOR-gates 52 and 53 and the diode 54 together form an oscillatory circuit 59, the output from which is fed to a NOR-gate 60, which acts as a push-pull amplifier to drive a piezo-electric audio transducer 61.

When the capacitor 16 in the module 1 is charged, (i.e. in the quiescent condition), the input of the gate 42 is held high, so that its output is at zero volts. This holds the transistor 46 off, so that the circuit 59 does not oscillate. However, when the flash tube 3 fires, the input of the gate 42 is pulled down instantaneously, so that its output rises for an instant to approximately 9 volts. This allows current to flow through a diode 43 to charge the capacitor 49. The diode 43 prevents the capacitor 49 from discharging through the gate 42 when the output of the gate reverts to zero volts, due to recharging of the capacitor 16.

The voltage across the charged capacitor 49 turns on the transistor 46, and allows the circuit 59 to oscillate. A high-frequency audio note will therefore by produced by the transducer 61. When the transistor 46 is conductive, the capacitor 49 discharges relatively slowly through the resistor 44 and the base-emitter circuit of the transistor. This gradually reduces the conductivity of the transistor so that the frequency of oscillation of the circuit 59 progressively decreases, until the transistor turns off completely. When a flash occurs, therefore, an audio output of decreasing frequency is produced, the sweep time from high frequency to zero output being approximately 1 second. If the flash tube is fired again within that sweep time, the voltage on the capacitor 49 will immediately rise, and the audio output will revert to high frequency and then sweep down again.

Additional sound effects such as warning of low battery power, different sounds for different power levels, different sounds for different firing rates, and sounds to indicate the emitter is charging and is ready or not ready for triggering can be obtained by adapting the sound unit or module 2 to operate according to the above conditions.

The output of the battery 39 is preferably 9 volts, to obtain a satisfactory audio output level, while keeping the weight, volume and safety of the unit at acceptable levels. The module 2 consumes an extremely low current while idling, so there is no need to provide an on/off switch for the module.

The gun may be used by itself, a hit or miss being observed by the position of a bright patch of light projected by the gun. The speed of operation of the circuitry is such that the user can fire the gun repeatedly at a fast rate. The rate which can be attained depends upon the trigger design and upon the type and condition of the battery. A fully-charged nickel cadmium battery will generally allow the gun to be fired more rapidly than a fresh alkaline battery, but the firing rate drops off more rapidly with a nickel cadmium battery.

In order to improve the signal to noise performance when using the gun, infrared diodes can be added to transmit coding pulses separately from the flash tube. These can be added such that they emit pulses coaxially with the flash tube by a suitable arrangement of mirror and lenses. If an infrared light bulb is used, the light from the bulb is visible and therefore can be used as a pointing beam. These coded signals could for example be used to identify various hits from friends or enemies. Hits from different forms of emitters, to identify the power level of the hit or to distinguish between pointing beams and actual hits.

Figure 3:
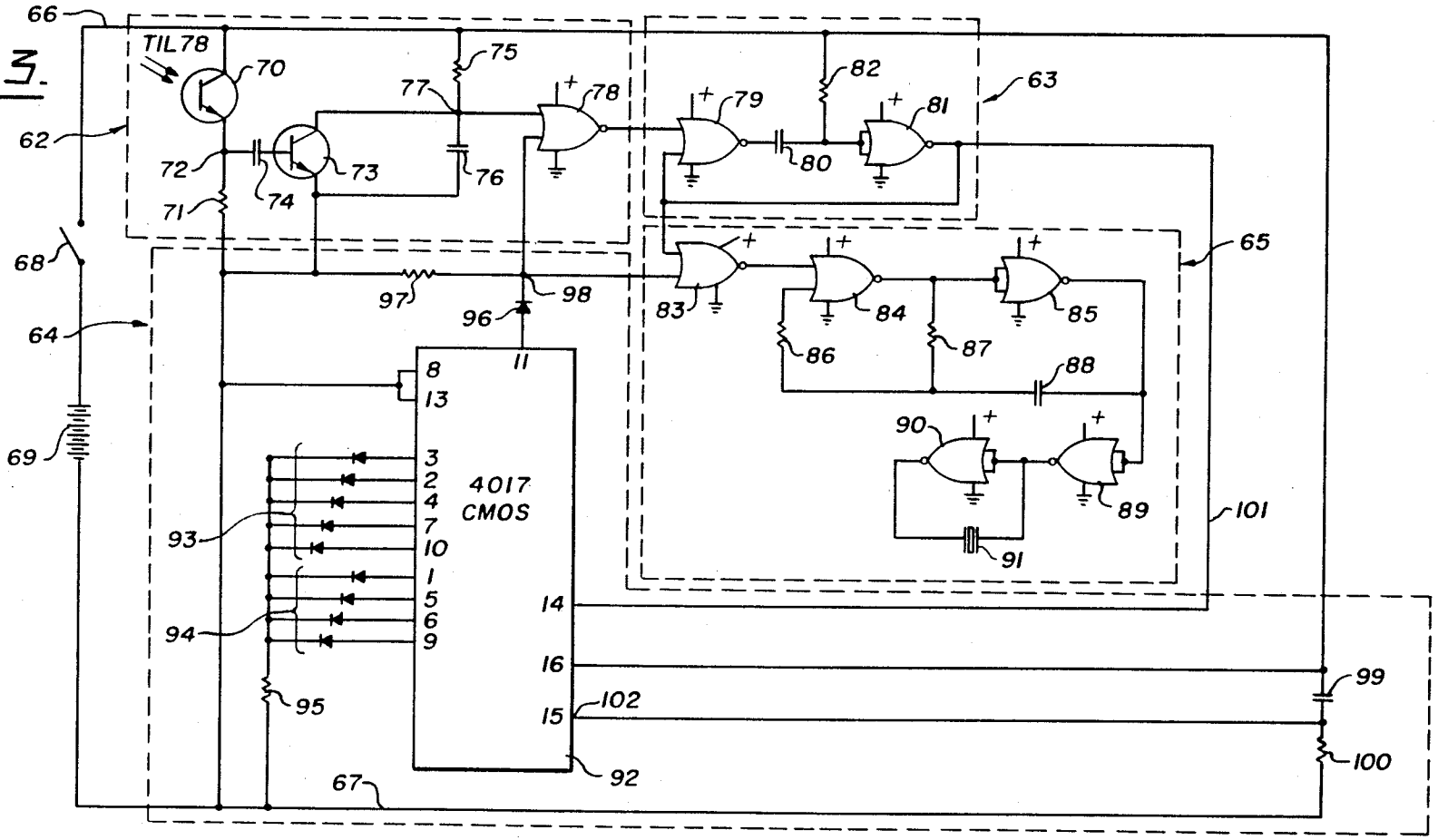
FIG. 3 is a circuit diagram of a receiver circuit forming part of a target for use with the gun.

Alternatively, an electronic target device may be used to register "hits". Such device, the circuit of which is shown in FIG. 3, comprises four modules, namely a light-sensing trigger module 62, a timer 63, a counter 64 and a sound effects module 65, which are energised from d.c. supply lines 66 and 67, connected, via a switch 68, to a battery 69.

The trigger module 62 comprises an infrared sensitive photo-transistor 70 which is connected, in series with a resistor 71, between the lines 66 and 67. The junction 72 between the anode of the diode 70 and the resistor 71 is coupled to the base electrode of a transistor 73, via a capacitor 74. The collector of the transistor is connected to the positive d.c. line 66 via a resistor 75. A capacitor 76 is connected across the transistor collector/emitter circuit. The junction 77 between the capacitor 76, the resistor 75 and the collector electrode is connected to one input of a NOR-gate 78. The output of the gate 78 is fed to the timer 63.

The timer comprises a NOR-gate 79, the output of which is fed to one terminal of a capacitor 80. The other terminal of the capacitor is connected to the input of a NOR-gate 81. A resistor 82 is connected between that input and the line 66. The output of the gate 81 is fed to the other input of the gate 79 and to the modules 64 and 65.

The sound effects module 65 comprises an input NOR-gate 83 and an oscillator comprising NOR-gates 84 and 85, resistors 86 and 87 and a capacitor 88. The output of the oscillator is fed to a NOR-gate 89 which acts as a buffer. A NOR-gate 90 acts as a push-pull amplifier, which drives a piezo-electric audio transducer 91.

The counter module 64 comprises an integrated circuit counter 92 which has a group of green LEDs 93 and a group of red LEDs 94 connected to its outputs of "1" to "9" significance. The cathodes of the LEDs are connected together and are connected to the line 67 via a resistor 95. The "10" output is connected to a red LED 96, the cathode of which is connected to the line 67 via a resistor 97. The junction 98 of the LED 96 and the resistor 97 is connected to the other inputs of the gates 78 and 83. A capacitor 99 and a resistor 100 are connected in series between the DC supply lines 66 and 67, the junction between the capacitor and the resistor being connected to a reset input 102 of the counter 92.

In operation of the circuit, the phototransistor 70 and the resistor 71 set the input level to the base of the transistor 73 so that, in the quiescent state, the transistor is cut off. The capacitor 76 charges up via the resistor 75. When a flash of light from the gun impinges on the photo-transistor the conductivity of the photo-transistor increases, the base potential of the transistor therefore rises, and the transistor 73 turns on. The capacitor 74 filters any low-frequency input changes, so that the transistor 73 is effected only by short bursts of light, and not by general changes in the ambient light level. When the transistor 73 turns on, it discharges the capacitor 76, and a pulse is thereby applied to one input of the NOR-gate 78 and is amplified thereby. The output of the gate triggers the timer 63.

Normally, the input to the gate 79 is held low, so that its output is at approximately 9 volts, thereby maintaining the capacitor 80 in an uncharged state. The output of the gate 81 is therefore at zero volts. When the timer is triggered in response to a flash of light, the output of the gate 79 drops to zero volts, thereby causing the capacitor 80 to charge, via the resistor 82. Instantaneously the input of the gate 81 changes from high to low level, so that its output goes from low to high level. This turns on the sound effects module 65 via the gate 83. When the capacitor 80 is charged up to a certain voltage, the input of the gate 81 reaches the high level, so that its output goes low. This turns off the sound effects module and begins to discharge the capacitor 80.

The gate 83 acts as a switch for the oscillator 84–88, and receives the output from the gate 81 in the timer circuit, as just explained, so that a tone is emitted each time a flash is sensed. It also receives an output from the counter 92.

The pulse from the gate 81, which is generated each time a flash is sensed, is fed over a line 101 to the clock input of the counter 92 so that the count is incremented by one for each flash which is sensed. The corresponding LED 93 and 94 is illuminated. When the count reaches ten, i.e. after ten "hits", the LED 96 lights, indicating the end of the game. The signal thereby applied to the gate 78 disables the timer 63 so that no further counting is effected. That signal is also applied to the gate 83, causing the sound effects oscillator to emit a tone. The counter can be reset, and the tone silenced, only by opening the switch 68 for a brief period, thereby switching off the d.c. supply. Each time the d.c. supply is switched on, the capacitor 99 charges up, via the resistor 100. This puts the reset input 102 of the counter 92 briefly at a high level, so that the counter is reset to zero. When the capacitor has charged up, the input 102 is held low, so that the counter can count normally. While the timer is in a timing cycle, it is not affected by the sensing of another flash until the counting of the flash already sensed is completed.

In order to provide a greater area of activity or play, a number of filters and an automatic levelling circuit can be added to the light sensing trigger module 62. These additions to the receiver will allow the receiver to function under a greater variety of light conditions. The receiver could be made to function under day light conditions as well as night time conditions.

In addition, if pulse coding is transmitted by the emitter, a logic circuit can be implemented to decipher the coding. Aside from improving the signal to noise ratio, pulse coding can be used to identify the different power level impinging on the receiver. This will signal the receiver the type of damage which is to be indicated. For example, a high power level hit can wear down the energy or score of the receiver faster than low power level hits. It can be used to identify the different types of emitters such as bow, gun, rifle, machine gun, granade, bomb, rocket launcher etc. Again, more powerful forms of the emitter can wear down the energy level of the receiver faster. It can also be used to identify friend or enemy. If team members are accidentally or deliberately hit, the logic circuits can be programmed to perform specified functions such as distinguish pointing beams from hitting beams. These logic circuits can be programmed to issue a warning that an emitter is pointed at the receiver.

The actual coding and decoding logic circuits which can be used in conjunction with the emitter and receiver, are readily available and can readily be implemented.

The LEDs 93 and 94 may be so arranged that, as the count in the counter 92 increases towards the count limit (i.e. the end of the game), the LEDs are illuminated in descending order, so that the player has a constant indication of the number of "lives" still remaining before the end-of-game alarm will sound.

In addition, visual hit indications can be improved to allow the players to see hits from a longer distance under different ambient light conditions. For example, a fluorescent belt can be adapted with a number of different openings to indicate a score. Also, a rotating disc with fluorescent spots at appropriate places can be rotated to different openings to indicate the score. Or, a rotating rod with spiral fluorescent strips again can be rotated to keep the score. Also, a small light bulb can be flashed to indicate hits and which the duration of a flash can be linked to the score.

By using an inductor to boost the voltage swing across the piezo-electric crystal 91, the sound effects can be made louder. Different sounds can be used to indicate various conditions. For example, hits by friend and enemy can result in different sounds. Or for example to warn a user that a pointing beam is being received by the receiver, to indicate when the game has ended, when the score changes or when a receiver is hit by different types of emitters.

Also, the function of the trigger module 62 can be adapted to respond to different light guns currently available on the market i.e. infrared, light bulb, flash tube, or combinations of the above.

Although numerous NOR-gates have been specified in the above description, it will be apparent that some of those gates could be replaced by NOT-gates. Those components have been proposed as NOR-gates merely because IC packages including several NOR-gates are readily obtainable, and such gates can be readily adapted for the required use by connecting their data inputs in parallel.

Many different games can be played by use of the gun and one or more of the electronic target devices. For example, two or more players can be equipped with guns and targets and a contest of accurate and fast shooting can be carried out between individuals or between teams of contestants. This can be advantageous in improving the speed of reaction and the coordination of the players. Alternatively, the target device may be affixed to a robot, a remote-controlled vehicle, a pet or another person, so that a player armed with a gun can "hunt" the moving target. One or more of the target devices could alternatively be used as stationary targets, possibly disposed at different distances from the firer. The gun, which relies only on bright flashes of light to give enjoyment to the player, provides a clean, safe and relatively cheap game. The provision of a "hit" counter allows each player to see instantly how close his opponent is to finishing the game, and thus increases the tension and excitement of the game. The tone produced each time a "hit" is registered also heightens tension in the wearer of the target and provides gratification for his opponent.

We claim:

1. A game comprising a toy gun, including an electronic flash tube; means to provide a relatively low-voltage direct current supply; means to produce from the low-voltage supply a relatively high-voltage unidirectional supply; means coupled to the high-voltage supply to fire the flash tube in response to pressure on a trigger of the gun; and a reflector positioned adjacent the flash tube to produce a beam of light; and a hollow concentrator having a relatively large diameter inlet into which the beam passes, and a relatively small diameter outlet which serves to concentrate the beam into a relatively narrow beam for projection at a target.

2. A game as claimed in claim 1, wherein the means to produce a relatively high-voltage supply comprises a transistor inverter.

3. A game as claimed in claim 2, wherein the means to fire the flash tube comprises a first capacitor which is charged from the high-voltage supply and which is discharged into a primary winding of a transformer, a secondary winding of which is connected to a trigger electrode of the tube.

4. A game as claimed in claim 3, wherein the means to fire the flash tube further comprises a second capacitor which is charged from the high-voltage supply and which is discharged through the tube when the tube is triggered.

5. A game as claimed in claim 4 including oscillator means which emits an audio-frequency signal as a short burst when the tube is triggered.

6. A game as claimed in claim 5, wherein the frequency of the audio signal sweeps rapidly downwards during the burst.

7. A game as claimed in claim 6, wherein lens means is mounted in the path of the emerging concentrated beam.

8. A game as claimed in claim 8, including means located between the outlet and the lens means to change the cross-section of the concentrated beam.

9. A game as claimed in claim 9, wherein the means to change the cross-section of the concentrated beam comprises a disc pivoted for rotation about its centre and having a plurality of apertures of different shapes and/or sizes adjacent its periphery for selective alignment with the outlet.

10. A game as claimed in claim 9, including filter means for changing the colour of the concentrated beam.

11. A game comprising a toy gun including an electronic flash tube; means to provide a relatively low-voltage direct current supply; means to produce from the low-voltage supply a relatively high-voltage unidirectional supply; means coupled to the high-voltage supply to fire the flash tube in response to pressure on a trigger of the gun; and a reflector positioned adjacent the flash tube to produce a beam of light; and a hollow concentrator having a relatively large diameter inlet into which the beam passes, and a relatively small diameter outlet which serves to concentrate the beam into a relatively narrow beam for projection at a target; in combination with an electronic target including means responsive to impinging of the beam of light thereon to provide audio-visual signals indicating that the gun has been accurately aimed thereat.

12. A game as claimed in claim 11, wherein the means to produce a relatively high-voltage supply comprises a transistor inverter.

13. A game as claimed in claim 12, wherein the means to fire the flash tube comprises a first capacitor which is charged from the high-voltage supply and which is discharged into a primary winding of a transformer, a secondary winding of which is connected to a trigger electrode of the tube.

14. A game as claimed in claim 13, wherein the means to fire the flash tube further comprises a second capacitor which is charged from the high-voltage supply and which is discharged through the tube when the tube is triggered.

15. A game as claimed in claim 14, including oscillator means which emits an audio-frequency signal as a short burst when the tube is triggered.

16. A game as claimed in claim 15, wherein the frequency of the audio signal sweeps rapidly downwards during the burst.

17. A game as claimed in claim 16, wherein lens means is mounted in the path of the emerging concentrated beam.

18. A game as claimed in claim 17, including means located between the outlet and the lens means to change the cross-section of the concentrated beam.

19. A game as claimed in claim 18, wherein the means to change the cross-section of the concentrated beam comprises a disc pivoted for rotation about its centre and having a plurality of apertures of different shapes and/or sizes adjacent its periphery for selective alignment with the outlet.

20. A game as claimed in claim 19, including filter means for changing the colour of the concentrated beam.

21. A game as claimed in claim 11, wherein the means to provide an output signal includes a photo-transistor.

22. A game as claimed in claim 21, including means to produce an audible tone when the light beam impinges on the target.

23. A game as claimed in claim 22, including counter means which is incremented each time the light beam impinges on the target until the count reaches a predetermined number.

24. A game as claimed in claim 23, wherein when the count reaches the predetermined number an audible signal is produced indicating such event.

25. A game as claimed in claim 24, wherein the audible signal can be silenced only by de-energizing the electronic target.

26. A game as claimed in claim 25, including means to reset the counter to zero when the electronic target is re-energized.

27. A game as claimed in claim 26, including means continuously operable to indicate the-state of the count.

28. A game as claimed in claim 27, including indicating means comprises a plurality of light-emitting devices.

* * * * *